US008752357B2

(12) United States Patent
Schiche et al.

(10) Patent No.: US 8,752,357 B2
(45) Date of Patent: Jun. 17, 2014

(54) THERMOFORM PACKAGING MACHINE AND METHOD OF OPERATING THE SAME

(75) Inventors: Hans-Christian Schiche, Buxheim (DE); Thomas Nassal, Bad Groenenbach (DE); Elmar Ehrmann, Bad Groenenbach (DE)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 223 days.

(21) Appl. No.: 13/284,077

(22) Filed: Oct. 28, 2011

(65) Prior Publication Data

US 2012/0108408 A1 May 3, 2012

(30) Foreign Application Priority Data

Oct. 28, 2010 (DE) ..... 10 2010 049 960

(51) Int. Cl.
*B65B 43/08* (2006.01)

(52) U.S. Cl.
USPC ..... 53/456; 53/389.3; 53/453; 53/559; 493/82

(58) Field of Classification Search
USPC ..... 493/194, 82, 56, 61, 73; 53/453, 456, 53/559, 558, 561, 389.1, 389.2, 389.3
See application file for complete search history.

(56) References Cited

U.S. PATENT DOCUMENTS

| | | | | |
|---|---|---|---|---|
| 3,771,670 | A | 11/1973 | Napoleone et al. | |
| 5,409,368 | A * | 4/1995 | Heiskell et al. | 425/301 |
| 5,518,361 | A | 5/1996 | Smith | |
| 5,605,527 | A * | 2/1997 | Gillieron | 493/342 |
| 5,951,238 | A | 9/1999 | Duecker | |
| 2005/0252351 | A1 * | 11/2005 | Natterer | 83/39 |

FOREIGN PATENT DOCUMENTS

| | | | |
|---|---|---|---|
| DE | 2705293 | C3 | 8/1977 |
| DE | 3526087 | A1 | 1/1987 |
| DE | 43 27 197 | A1 | 2/1995 |
| DE | 102006000005 | A1 | 7/2006 |
| GB | 1603537 | | 11/1981 |

OTHER PUBLICATIONS

European Patent Office Communication Dated Feb. 2, 2012, Applicant Multivac Sepp Haggenmueller GmbH & Co. KG, Application No. 11008378.9-2308.

* cited by examiner

*Primary Examiner* — Christopher Harmon
(74) *Attorney, Agent, or Firm* — Husch Blackwell LLP

(57) ABSTRACT

A thermoform packaging machine comprising at least one cross cutting station that includes a punching device for cutting out strip cuts from a packaging film. The thermoform packaging machine also includes a receptacle for receiving a stack of a plurality of the strip cuts and a slide element for supporting the weight of the stack during operation of the punching device. The slide may be position to be inserted between two adjacent strip cuts in the stack in the receptacle. A method of operating such a thermoform packaging machine is also described.

19 Claims, 4 Drawing Sheets

THERMOFORM PACKAGING MACHINE AND METHOD OF OPERATING THE SAME

CROSS-REFERENCE TO RELATED APPLICATIONS

This application claims foreign priority benefits under 35 U.S.C. §119(a)-(d) to German patent application number DE 102010049960.9, filed Oct. 28, 2010 which is incorporated by reference in its entirety.

TECHNICAL FIELD

The present disclosure relates to a thermoform packaging machine as well as to a method of operating a thermoform packaging machine for punching out strip cuts.

BACKGROUND

In thermoform packaging machines, a trough is normally formed in a bottom film/foil in a forming station, the trough being then filled with a product and sealed with a top film in an airtight manner in a sealing station under vacuum and/or a modified atmosphere. The packages produced in this way constitute a compound which is interconnected through the bottom film and are conveyed through the thermoform packaging machine by means of clamp chains provided on both sides of the film. For separating the individual packages from the compound of bottom and top films, a combination comprising a cross cutting station and a subsequent longitudinal cutting station may be provided. In the cross cutting station the compound of bottom and top films is cut transversely to the conveying direction, or strip cuts are punched out if radii should be necessary on the edges of the packages. In this case, the knife may punch out the strip cuts from above, which means that the strip cuts will drop. If there should not be sufficient space for a unit for collecting the strip cuts within the machine frame or for removing them from the machine frame, the punching tool may punch out the strip cuts from below in an upward direction. These strip cuts will then be pushed further up in a receptacle after each step and can finally be removed in one go. In high-performance machines, the receptacles are very high so that they need not be emptied constantly. The strip cuts are here pushed over a projection which extends above a film conveying plane and on which part of the strip cut punched out last rests with its edge thus preventing the strip cuts stacked thereabove from dropping into the cross cutting station and on the packages to be cut. In the latter case malfunctions would be caused in the thermoform packaging machine.

Especially if the strip cuts in question are comparatively thin or not flexurally rigid, there will be a high risk that the weight of the stacked strip cuts cannot be held by the lowermost supported strip cut.

SUMMARY

An object of the present disclosure is to provide a thermoform packaging machine and a method of operating the same, by means of which the above described drawbacks can be eliminated.

The thermoform packaging machine is characterized in that it comprises at least one cross cutting station and a longitudinal cutting station, said cross cutting station including a punching device so as to cut out a strip cut from a bottom film and/or a top film by means of a punching tool, said punching device being preferably oriented substantially transversely to a conveying direction and including a receptacle for receiving therein the strip cut above the bottom film and/or the top film. The cross cutting station is provided with at least one slide so as to support part of the strip cuts located in the receptacle and above the slide. Preferably, the slide is arranged as closely as possible above the conveying plane of the bottom film. Such a slide and its position guarantee that the strip cuts resting on the slide will not press on the strip cuts located therebelow. Since only a small number of strip cuts is disposed between the conveying plane of the bottom film and the slide, said strip cuts can be supported by a projection provided in the receptacle due their low own weight and, in the case of thin films, in spite of their lack of flexural rigidity.

The slide is adapted to be moved in the receptacle preferably in a plane substantially parallel to a conveying plane of the bottom film, so as to guarantee that the slide can reliably be inserted between two strip cuts.

Preferably, the punching device comprises holding elements so as to support a plurality of strip cuts located above the conveying plane of the bottom film and below the slide. By means of such holding elements individual strip cuts can be supported, and this will reduce still further the weight on the lowermost strip cut, which is the strip cut that has been cut out last. The strip cut that has been cut out last and the strip cuts located thereabove are prevented from dropping.

According to a preferred embodiment, the holding elements are sawtooth-shaped, on the one hand for providing a support for at least part of the strip cuts and, on the other hand, for allowing the strip cuts to be easily pushed further up past the projections of the holding elements. The holding elements have a plurality of horizontal projections on different levels between which a bevel is disposed.

The slide preferably has a beveled (inclined) leading edge, so that insertion of the slide between two superimposed strip cuts will be guaranteed. The slide can be implemented as a flat plate or in the form of a rake or a fork.

Preferably, the slide is adapted to be driven by means of a pneumatic drive, e.g. a pneumatic cylinder, or an electric drive, preferably a servo motor or a solenoid, so as to guarantee a fast movement and exact positioning of the slide relative to the strip cuts.

A method according to the present disclosure, used for operating a thermoform packaging machine, is so conceived that it comprises at least one cross cutting station and a longitudinal cutting station, said cross cutting station including a punching device so as to cut out a strip cut from a bottom film and/or a top film by means of a punching tool, and it is so conceived that a slide is moved away from the strip cuts prior to or during a punching operation, a further strip cut is pushed upwards, and the slide is then moved to a position between two neighboring and superimposed strip cuts so as to support the strip cuts located above the slide. It is thus guaranteed that the slide movement is executed as long as a stack of strip cuts is at rest.

Preferably, the movement of the slide is executed by means of a controller, since the controller is in the possession of all information on the processes taking place in the packaging machine and, in particular, on the sensors and actuators of the cross cutting station and is therefore able to guarantee an efficient and process-reliable sequence of operations.

Preferably, the slide is moved out of a stack of strip cuts in a receptacle before the punching tool starts the punching operation or the punching tool comes into contact with the bottom film or the conveyance of the bottom film and the top film into the cross cutting station has been finished.

The slide is preferably moved into the stack of strip cuts in the receptacle before the punching tool is moved downwards again after the punching operation, so as to support all the strip cuts positioned above the slide and relieve the strip cuts positioned therebelow.

In the following, an advantageous embodiment of the thermoform packaging machine according to the present disclosure and of the method according to the present disclosure will be explained in more detail with reference to the below drawings.

DETAILED DESCRIPTION

Figure 1:
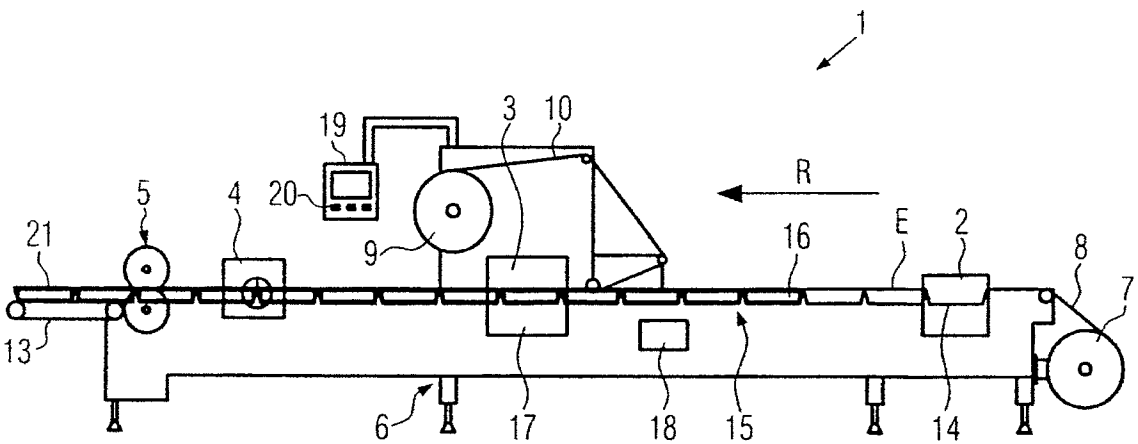
FIG. 1 is a schematic view of a thermoform packaging machine according to the present disclosure.

Components corresponding to one another are normally designated by the same reference numerals throughout the figures.

FIG. 1 shows in a schematic view a packaging machine according to the present disclosure in the form of a thermoform packaging machine 1. The thermoform packaging machine 1 comprises a forming station 2, a sealing station 3, a cross cutting station 4 and a longitudinal cutting station 5, which are arranged on a machine frame 6 in this sequence in a working direction R. On the input side, the machine frame 6 has provided thereon a supply roll 7 from which a bottom film/foil 8 is unwound. In the area of the sealing station 3 a material storage unit 9 is provided, from which a top film 10 is unwound. On the output side, a discharge unit 13 in the form of a conveyor belt is provided on the packaging machine, said discharge unit 13 being used for removing finished packages 21 which have been separated from one another. In addition, the packaging machine 1 is provided with a feed unit, which is not shown, said feed unit gripping the bottom film 8 and advancing it clockwise in the working direction R in a main work cycle. The feed unit may be realized e.g. by laterally arranged conveyor chains and convey the bottom film 8 in a conveying plane E.

In the embodiment shown, the forming station 2 is implemented as a thermoforming station in which containers 14 are formed in the bottom film 8 by thermoforming. The forming station 2 can be configured such that several containers are formed side by side in a direction perpendicular to the working direction R. An infeed line 15 is provided downstream of the forming station 2 when seen in the working direction R. On said infeed line 15 the containers 14 formed in the bottom film 8 are filled with products 16.

The sealing station 3 is provided with a closable chamber 17 in which the atmosphere in the container 14 can be replaced by a substitute gas or a substitute gas mixture, e.g. by means of gas flushing, before said container 14 is sealed.

The cross cutting station 4 is configured as a strip punch, which cuts through the bottom film 8 and the top film 10 in a direction transversely to the working direction R between neighboring containers 14. The cross cutting station 4 operates such that the bottom film 8 is not cut through across its whole width, but remains uncut at least in a boundary area and between two neighboring containers 14. The containers 14 can thus be advanced by the feed unit in a controlled manner.

In the embodiment shown, the longitudinal cutting station 5 is configured as a knife assembly by means of which the bottom film 8 and the top film 10 are cut through between neighboring containers 14 and at the lateral edge of the bottom film 8 so that individual packages 21 are obtained downstream of the longitudinal cutting station 5.

The thermoform packaging machine 1 is additionally provided with a controller 18. This controller 18 has the function of controlling and supervising the processes taking place in the packaging machine 1. A display device 19 provided with control elements 20 is used for making the processes in the thermoform packaging machine 1 visible to and for influencing them through an operator.

The general mode of operation of the packaging machine 1 is briefly described hereinbelow.

The bottom film 8 is unwound from the supply roll 7 and conveyed into the forming station 2 by means of the feed unit. In the forming station 2, containers 14 are formed in the bottom film 8 by means of thermoforming. The containers 14, together with the bottom film portion extending therearound, are advanced in a main work cycle to the infeed line 15 where they are filled with a product 16.

Subsequently, the filled containers 14, together with the bottom film portion extending therearound, are advanced into the sealing station 3 by means of the feed unit in said main work cycle. After having been sealed onto the bottom film 8, the top film 10 is advanced along with the feed movement of the bottom film 8. In the course of this movement, the top film 10 is unwound from the material storage unit 9. Due to the sealing of the top film 10 onto the containers 14, sealed packages 21 are produced.

Figure 2:
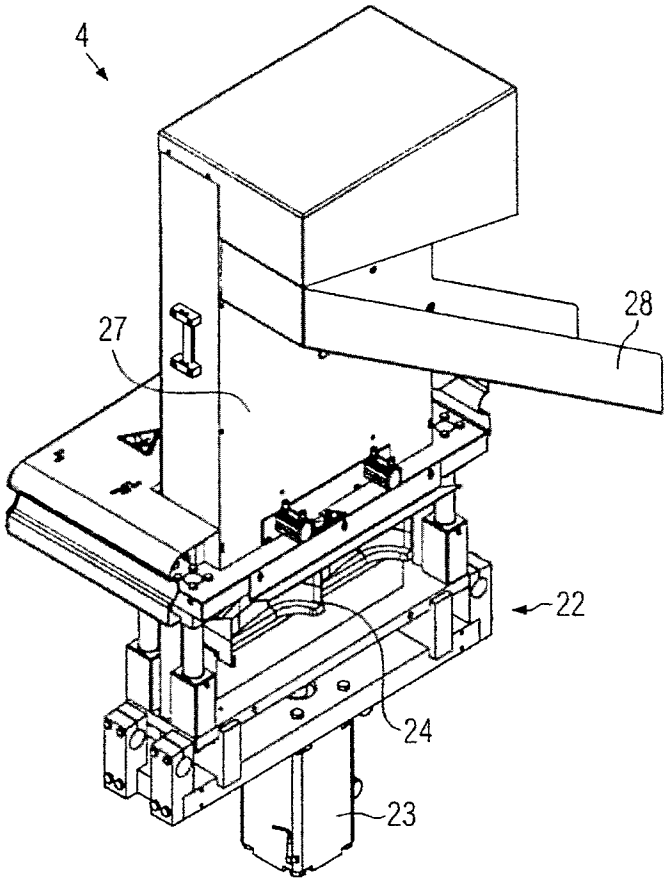
FIG. 2 is a schematic view of a cross cutting station.

FIG. 2 shows a cross cutting station 4 with a punching device 22 which, by means of a pneumatic drive 23, moves a punching tool 24 upwards against the bottom film 8 and the top film 10, which are not shown, and, in so doing, cuts out a strip cut 25 (cf. FIG. 4) from the compound consisting of said bottom film 8 and said top film 10. During the continued upward movement, the strip cut 25 is advanced to such an extent that it will be supported by holding elements 26 so as to prevent it from dropping.

In the subsequent main work cycles, further strip cuts 25 are pushed upwards into a receptacle 27. As soon as the stack of strip cuts 25 has reached a certain height in the upper area of the receptacle 27, the uppermost strip cuts 25 will laterally drop onto a discharger 28 and can subsequently be supplied to a collecting unit.

Figure 3:
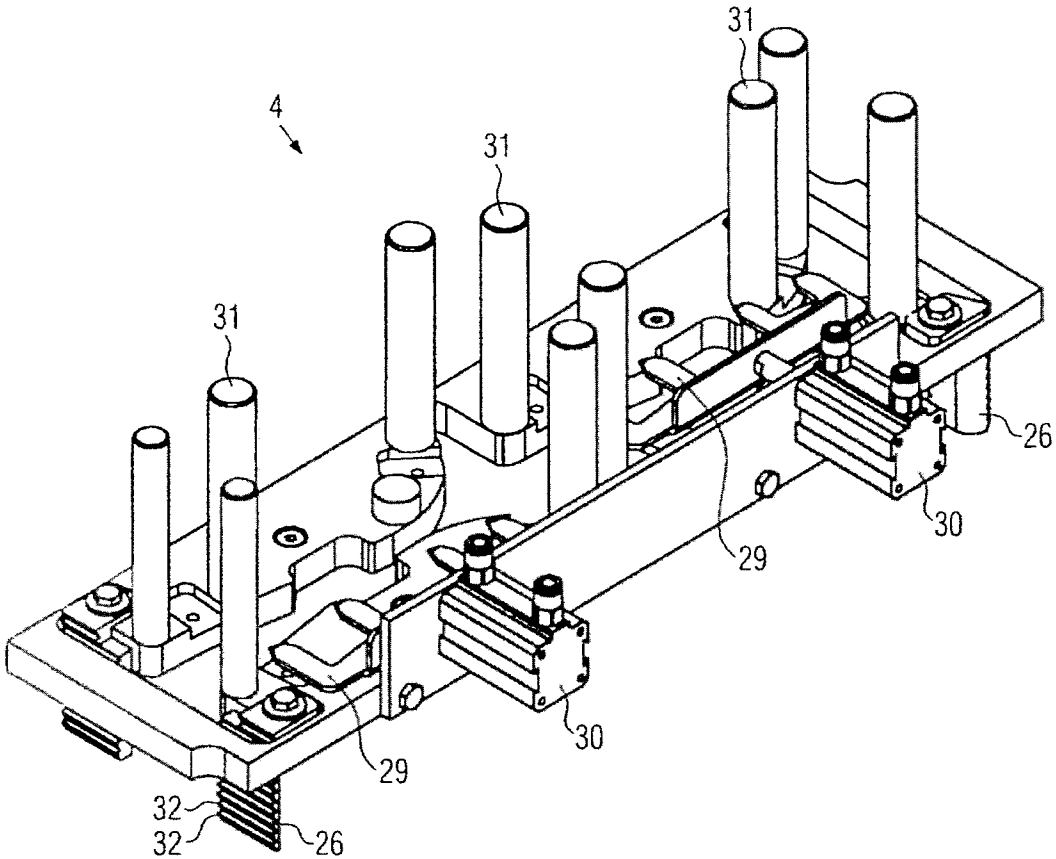
FIG. 3 is a schematic view into the upper area of a cross cutting station.

FIG. 3 shows two slides 29 which have the shape of a rake or a fork and which are adapted to be moved within the receptacle 27 by means of pneumatic cylinders 30 in the direction of a stack of strip cuts 25, which is not shown, and back again into the opposite direction. The stack of strip cuts 25 is guided by guide means 31 such that the position of the individual strip cuts 25 is retained in the transverse and in the longitudinal direction. The holding elements 26 are provided with sawtooth-shaped projections 32, which hold a boundary area of a strip cut 25 so as to prevent the latter from dropping back into the punching device 22 while the punching tool 24 is moved in a downward return movement to a parking position. In the subsequent main work cycle, the next strip cut 25 is pushed upwards and, during this upward movement, it pushes the preceding strip cut 25 further up by a distance corresponding to one projection 32 on the holding elements 26. The horizontal projections 32 are disposed on the holding element 26 on different levels.

Figure 4:
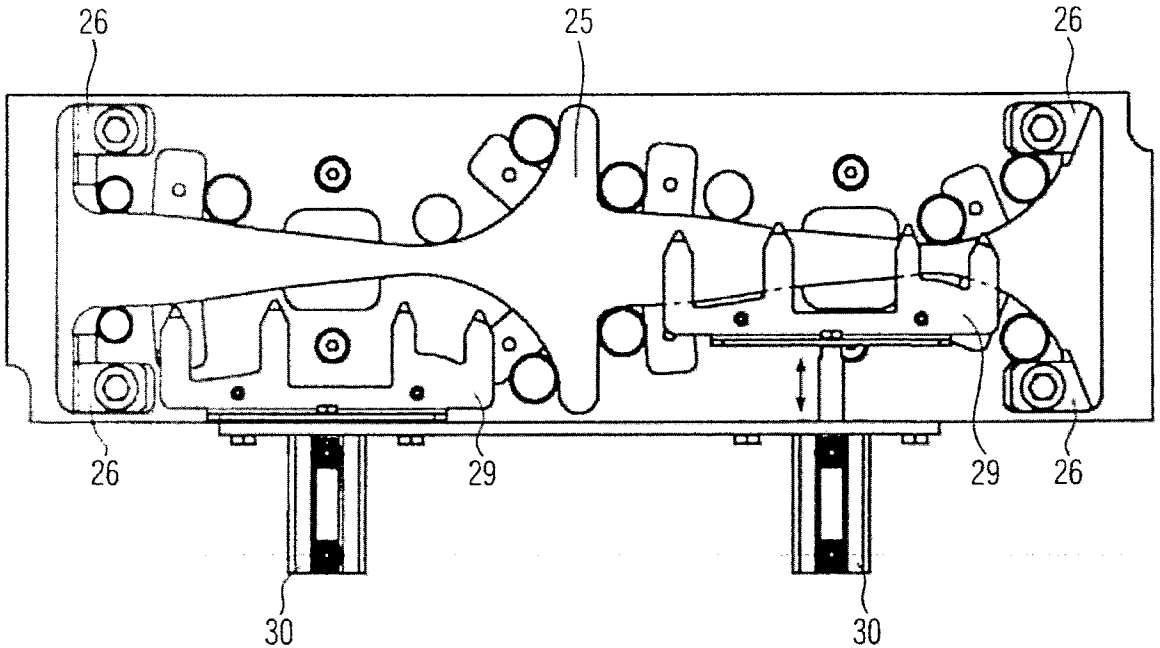
FIG. 4 is a top view of the cross cutting station.

In FIG. 4 the slides 29 are shown at two positions. The slide 29 located on the left, when seen in a top view, occupies a position outside of the stack of strip cuts 25, and the slide 29 shown on the right occupies the position at which it is moved between two strip cuts 25 of said stack and supports consequently the strip cuts 25 located thereabove such that they are prevented from dropping. The slides 29 are preferably moved in synchronism. The movement of the slides 29 into the stack of strip cuts 25 takes place as soon as the punching tool 24 has finished the punching operation at the uppermost position. As soon as the slides 29 have been moved in and support the upper part of the stack, the punching tool 24 moves downwards. The slides 29 are arranged in or on the receptacle 27 directly above the punching device 22 so that only a small number of strip cuts 25 will be located between the conveying plane E of the bottom film 8 and the slides 29.

The slides 29 are preferably provided with a bevel or inclination in the front portion 31 thereof. This bevel may also be provided on the upper and lower surfaces of the slide 29. The slides 29 need not be provided in common on the same side; also a variant comprising opposed slides 29 is imaginable. These slides 29 can then be moved into one another in the form of rakes. Also a further variant is imaginable, in the case of which one or a plurality of slides 29 are not movable in the conveying direction of the bottom film 8 but orthogonally to or at an oblique angle to said conveying direction.

The cross cutting station 4 may be arranged as a single or as an additional cross cutting station 4 between the forming station 2 and the sealing station 3 so as to cut (only) the bottom film 8. Likewise, it is imaginable to dispose the cross cutting station 4 or an additional cross cutting station 4 between the material storage unit 9 and the sealing station 3 so as to cut (only) the top film 10.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A thermoform packaging machine comprising:

at least one cross cutting station; and a longitudinal cutting station;

the cross cutting station including a punching device having a punching tool capable of cutting out a strip cut from a bottom film and/or a top film, the punching device being oriented transversely to a conveying direction of the films, and the cross cutting station including a receptacle for receiving the strip cut above the bottom film and/or the top film, the receptacle including a plurality of guide elements for guiding a vertical stack of a plurality of the strip cuts, wherein the cross cutting station is provided with at least one slide, the slide being adapted to be moved in the receptacle so as to temporarily support of a portion of the stack of the strip cuts located in the receptacle and above the slide.

2. The thermoform packaging machine according to claim 1, wherein the slide is adapted to be moved in a plane substantially parallel to a conveying plane of the bottom film.

3. The thermoform packaging machine according to claim 1, wherein the punching device comprises vertically orientated holding elements having a plurality of substantially horizontal projections vertically disposed thereon, each horizontal projection for supporting one or more of the strip cuts located above the conveying plane of the bottom film and below the slide.

4. The thermoform packaging machine according to claim 3, wherein the holding elements are sawtooth-shaped.

5. The thermoform packaging machine according to claim 1, wherein the slide has a beveled leading edge.

6. The thermoform packaging machine according to claim 1, wherein the slide is adapted to be driven by a pneumatic or an electric drive.

7. A method of operating a thermoform packaging machine comprising at least one cross cutting station and a longitudinal cutting station, the cross cutting station including a punching device having a punching tool capable of cutting out a strip cut from a bottom film and/or a top film, the method comprising:

displacing at least one slide away from a stack of the strip cuts prior to or during a punching operation, and pushing at least one strip cut upwards past the slide wherein at least a portion of the stack of the strip cuts are guided in a receptacle by one or more guide elements, displacing the slide to a position between two neighboring and superimposed strip cuts in the stack so as to support a portion of the stack of the strip cuts located above the slide.

8. The method according to claim 7, wherein the slide is displaced away from the stack of strip cuts in the receptacle before the punching tool starts the punching operation, or before the punching tool comes into contact with the bottom film, or before the conveyance of the bottom film and the top film into the cross cutting station has been finished.

9. The method according to claim 8, wherein the slide is displaced to a position between two neighboring and superimposed strip cuts in the stack of strip cuts in the receptacle before the punching tool is moved downwards again after the punching operation.

10. A thermoform packaging machine comprising:

a container forming station capable of forming containers from a bottom film, the bottom film capable of moving in a conveying direction;

a sealing station capable of sealing containers with a top film;

a cross cutting station; and a longitudinal cutting station;

the cross cutting station including:

a punching tool capable of cutting out a strip cut from at least one of the bottom film and the top film;

a receptacle above the bottom film and/or the top film for receiving the strip cut, the receptacle including a plurality of guide elements for guiding a vertical stack of a plurality of the strip cuts; and a slide adapted to be moved in the receptacle to temporarily support a portion of the stack of the strip cuts located in the receptacle.

11. The thermoform packaging machine according to claim 10, wherein the slide is adapted to be moved in a plane substantially parallel to a conveying plane of the bottom film and support the strip cuts above the slide.

12. The thermoform packaging machine according to claim 10, wherein the punching tool is part of a punching device that is oriented transversely to the conveying direction, the punching device further comprising vertically orientated holding elements having a plurality of substantially horizontal projections vertically disposed thereon, each horizontal projection for supporting one or more of the strip cuts located above the conveying plane of the bottom film and below the slide.

13. The thermoform packaging machine according to claim 12, wherein the holding elements are sawtooth-shaped.

14. The thermoform packaging machine according to claim 10, wherein the slide has a beveled leading edge.

15. The thermoform packaging machine according to claim 10, wherein the slide is adapted to be driven by a pneumatic or an electric drive.

16. The thermoform packaging machine according to claim 1 wherein the receptacle has a first end and a second end and said slide is positioned between said first end and said second end.

17. The thermoform packaging machine according to claim 1 wherein the slide has a fork-shape including at least two arms wherein said arms of said slide extend into said receptacle without engaging said guide elements.

18. The thermoform packaging machine according to claim 10 wherein the receptacle has a first end and a second end and said slide is positioned between said first end and said second end.

19. The thermoform packaging machine according to claim 10 wherein the slide has a fork-shape including at least two arms being separated by a space wherein said arms of said slide extend into said receptacle without engaging said guide elements.

* * * * *